US005384441A

United States Patent [19]

Balaban et al.

[11] Patent Number: 5,384,441

[45] Date of Patent: Jan. 24, 1995

[54] ELECTRICAL ROCKER TYPE SWITCH

[75] Inventors: David B. Balaban, Hauppauge; Anthony Tufano, North Massapequa, both of N.Y.

[73] Assignee: Leviton Manufacturing Co., Inc., Little Neck, N.Y.

[21] Appl. No.: 168,587

[22] Filed: Dec. 14, 1993

Related U.S. Application Data

[63] Continuation of Ser. No. 984,397, Dec. 9, 1992, abandoned.

[51] Int. Cl.[6] ..... H01H 3/12

[52] U.S. Cl. ..... 200/339; 200/557

[58] Field of Search ..... 200/557, 339

[56] References Cited

U.S. PATENT DOCUMENTS

| | | | |
|---|---|---|---|
| 1,782,780 | 11/1930 | Hafemeister . | |
| 2,570,281 | 10/1951 | Russell et al. . | |
| 2,899,513 | 8/1959 | Schmidt . | |
| 2,939,926 | 6/1960 | Lamqudiere . | |
| 3,172,972 | 3/1965 | Schleicher | 200/557 |
| 3,246,087 | 4/1966 | Haviland | 200/339 |
| 3,300,605 | 1/1967 | Ramsing et al. . | |
| 3,354,275 | 11/1967 | Schleicher . | |
| 3,427,418 | 2/1969 | Norden | 200/559 |
| 3,532,846 | 10/1970 | Schumacher . | |
| 3,713,071 | 1/1973 | Poliak et al. . | |
| 3,770,920 | 11/1973 | Poliak . | |
| 4,837,411 | 6/1989 | Best | 200/339 |

FOREIGN PATENT DOCUMENTS

| | | | |
|---|---|---|---|
| 44-21610 | 9/1969 | Japan | 200/559 |

*Primary Examiner*—Ernest G. Cusick
*Attorney, Agent, or Firm*—Paul J. Sutton

[57] ABSTRACT

An electrical rocker type wall switch capable of single, duplex and triplex configurations incorporates one or more slightly concave manually depressible rockers. These rockers have a relatively short range of motion from their respective on to off positions. The edges of the rocker lie substantially flush with the switch cover when in either of their on or off positions. Switching is actuated by an actuating arm attached to the rocker moving a contact on the end of a movable brush arm in and out of electrical contact with a fixed contact on the end of a contact arm attached to a fixed terminal. One or more brush arms extend from a fixed brush backplate and are formed so as to be resilient. Switch toggling is achieved by using a toggle spring, held in place on the end of a toggle arm, which is compressed during the first half of travel of the rocker from its resting position and expands as the rocker crosses its midway point toward the second half of travel to its resting position on the other side of the switch. The toggle spring sits centrally over a spring pivot which has two spring stops on either side of it to support the toggle spring at the on and off position of the rocker.

16 Claims, 8 Drawing Sheets

ELECTRICAL ROCKER TYPE SWITCH

This is a continuation of application Ser. No. 07/984,397, filed Dec. 9, 1992 and now abandoned.

BACKGROUND OF THE INVENTION

1. Field of the Invention

The present invention relates to a rocker-type electrical switch suitable for commercial and home use.

2. Description of the Prior Art

Known is a rocker-type electrical wall switch which comprises a rocker pivotally supported in a housing at a first pivot point, a movable contact brush pivotally supported at a second pivot point in the housing, a spring compressed between a downwardly extending boss on the rocker and a lower end of the contact brush, the spring being movable under compression to inclined positions relative to the brush in response to pivotal movement of the rocker between rest positions, the movement of the spring transmitting pivotal movement of the rocker to the brush, and a pair of spaced cams engaging, respectively, with the upper end of the brush at a point above the second pivot point, and the rocker and cams being movable into engagement with the brush under pressure exerted by the spring on the rocker.

Other known devices of some relevance to the present invention are one which discloses a safety snap switch; one which teaches a snap switch based on the engagement between a rigid member, able to oscillate, and a resilient prestressed contact in such a manner that rebound is substantially prevented; one which teaches a number of toggle type switches having various contact structures; one which teaches a switch including a contact-carrying rocker, the movement of which is produced by a compression spring, the axis of which coincides with that of a control knob or a lever, the spring transmitting its action to the rocker through a link or stirrup engaging through its end on the one hand, the rocker, and on the other hand, the spring; one which teaches a snap-action electrical switch with contact dampening means to quiet the action of lever-operated electric switches; one which teaches an electrical toggle switch having a mounting that can oscillate for the contact in the inner position and association of the mounting with a simple form of an essentially leaf-type spring; one which teaches a noiseless electric switch having a pivoted operating lever biased into two switch positions by a leaf spring and the lever; and one which teaches a compact electrical contact and electrical switch structure having a combination of a screw terminal, a push-in wire terminal, and a make or break electrical contact terminal, with the three terminals being formed in a single compact electrical structure from a small piece of metal strip bent at right angles between the screw terminal and the push-in terminal.

Also known is a device which comprises a mounting strap for supporting a wiring device in a metal wall box and establishing an electrical connection between the metal mounting screw and the strap. The mounting screw is inserted through the strap and threaded into a metal box or gem box.

BRIEF DESCRIPTION OF THE DRAWINGS

In the Drawings in which similar elements are given similar reference characters.

DESCRIPTION OF THE PREFERRED EMBODIMENT

Figure 1:
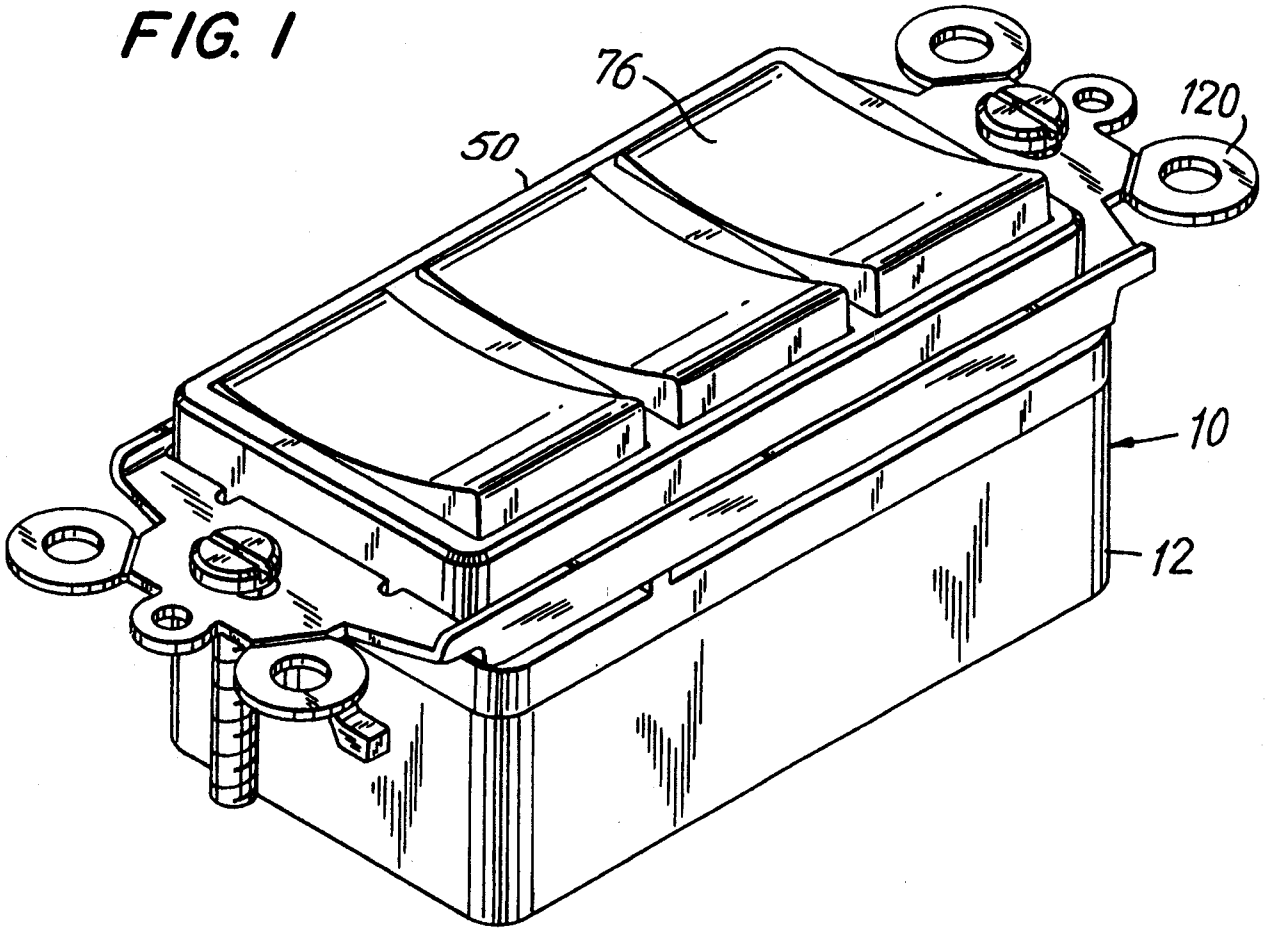
FIG. 1 is a perspective view of the preferred embodiment of the invention.

Referring to the drawings in detail, FIG. 1 depicts a top right perspective view of the preferred embodiment of the invention showing a electrical rocker type switch 10. This invention contemplates an assembly consisting of either a single or a plurality (i.e. two or three) of similar or different types of switching means. The major components shown are three rockers 76 that provide switch actuating means; a base 12 that houses internal components; a cover 50 that mates with the base 10 and provides pivoting means for the rockers 76; and a sheet metal mounting strap 120 that provides fastening means for holding cover 50 and the base 12 together. Electrical components such as terminal assembly 96, brush assembly 112 and toggling components are located within the base 12 and are not shown in the figure. An important aspect of this design is that only one common input terminal or wire is needed to supply power to the one or more switching means that are contemplated in this invention.

The base 12, cover 50 and rockers 76 are all single piece components each suitable for manufacturing as one piece by injection molding of a high impact thermoplastic material. In the preferred embodiment, these are the only plastic components of the switch 10 with the other components being made either of metal or rubber. The switch was designed to have a minimum number of parts which serves to reduce its cost in terms of materials needed and ease of assembly. The entire device consists of only eleven different types of components with the total number of components being twenty five.

Figure 2:
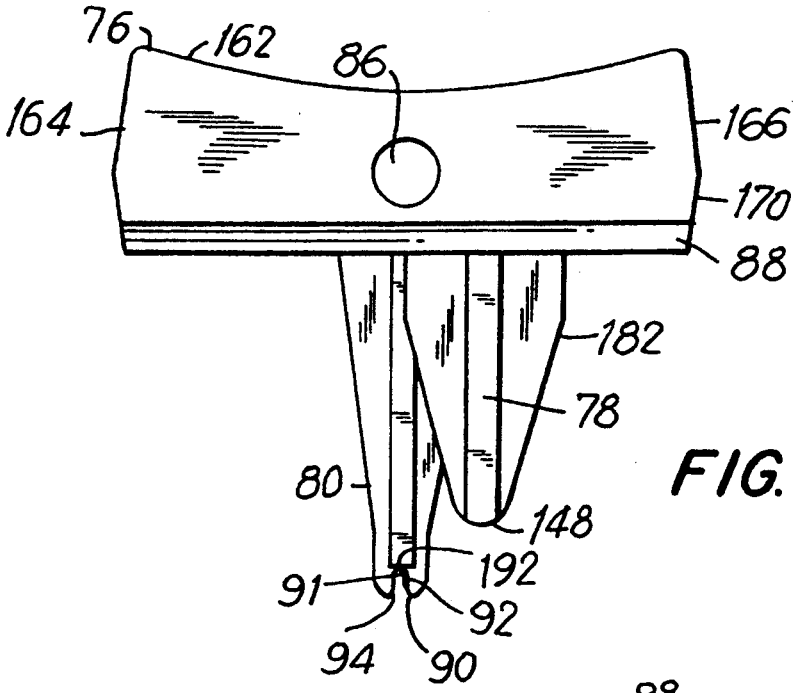
FIG. 2 is a side view of a rocker showing the toggle arm and actuating arm.
Figure 3:
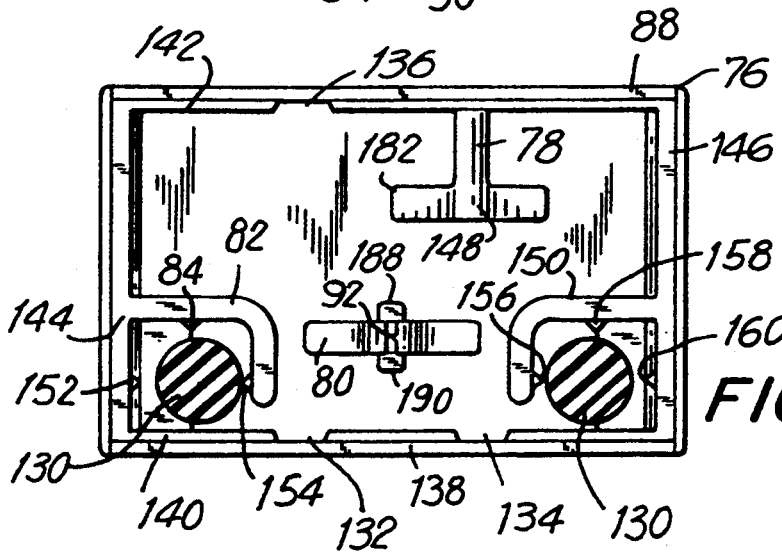
FIG. 3 is a view of the underside of the rocker.
Figure 4:
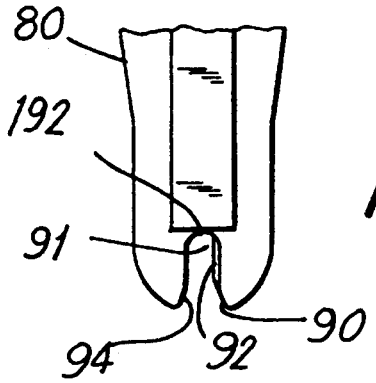
FIG. 4 is a partially exploded view of the bottom portion of the toggle arm.

The rockers 76, shown in FIGS. 2, 3 and 4, have a rectangular shape with an inner portion formed underneath by relatively short side walls 144, 146 and relatively long end walls 88, 138. The rocker cover 162 is smoothly curved concavely with a radius of approximately 4 inches and is symmetrical about an axis perpendicular to the paper as shown in FIG. 2. There is no line in the center of the rockers employed on this switch. The face of the rocker is a continuous arc which offers a design very pleasing to the eye. Extending over its entire width, the rocker cover 162 curvature is smooth and uniform. The width of the rocker cover 162, slightly less than the overall width of the rocker 76, makes up 80 to 90% of the width of the switch 10. The outwardly exposed surface of the rocker cover 162 is relatively large, highly polished and smooth to provide a comfortable feel and attractive appearance.

The side walls 144, 146 and end walls 88, 138 form an inner recess underneath the rocker cover 162. Side walls 144, 146 each have two surfaces that are flat but meet at an angle of 7° with respect to each other. Upper rocker sidewalls 164, 166 extend downward from the rocker cover 162 approximately two thirds of the height of sidewalls 144, 146 respectively. Lower rocker sidewalls 168, 170 extend from the lower edge of the upper rocker sidewalls 164, 166 to the bottom edge of the sidewalls 144, 146 respectively. During normal switch use, the lower rocker sidewalls 168, 170 are hidden from view as the rockers 76 are toggled from the off to on or on to off position. When the rocker is at its maximum travel, i.e. the switch is in either the on or off position, the joint line between upper rocker sidewalls 164, 166 and lower rocker sidewalls 168, 170 is approximately flush with the top surface of the cover 50.

At the midpoint, both in width and height, of endwalls 88, 138 are pivot holes 86 of approximately ⅛ inch in diameter. These pivot holes 86 accept the pivots 62, 172, 174, 176, 178, 180 allowing the rockers 76 to pivot on an axis perpendicular to its width in the horizontal plane. Located on the lower portion of end walls 88, 138 are the beveled edges 140, 142 extending the entire length between both side walls 144, 146. These edges assist during assembly of the switch 10 by providing pivots 62, 172, 174, 176, 178, 180 with a smooth flat surface as the rockers 76 are inserted into the cover 50. To further aid in assembly, end wall cutouts 132, 134, located on either side of the pivot hole 86 on the inner surface of end wall 138, allow for flexibility and expansion of end wall material during insertion of rockers 76. Similarly, end wall cutout 136, located on the inner surface of the end wall 88, assists insertion in like manner. End wall cutouts 132, 134 and 136 are rectangular in shape running vertically from the inner surface of the rocker cover 162 straight down to the lower portions of beveled edges 140, 142 and are about half the thickness of the end walls 88, 138.

Extending downwardly from the underside of the rocker cover 162 is a long and narrow actuating arm 182 which actuates the on and off control of the switch 10. It is approximately ¾ inch in length and located two thirds of the distance between both end walls 88, 138 and side walls 144, 146. Actuating arm 182 is T-shaped, as shown in FIG. 3, formed by the reinforcing portion 78 and the actuating portion 148. The reinforcing portion 78 is part of the inner surface of endwall 88 on the side of the pivot hole 86 opposite end wall cutout 136. The actuating portion 148 is a flat vertical projection that begins to narrow in width approximately midway from its end and linearly tapers to a rounded point at its end. The rounded tips of actuating arms 182 contact the brush arms 110, 184, 186 and cause the switch 10 to open and close. The rigid actuating arm 182 is constructed to handle the stresses during actuation in both normal and harsh use.

A toggling arm 80, located midway between the side walls 144, 146 and one third the distance between the end walls 88, 138, projects downwardly from the underside of the rocker cover 162 in a linearly sloping manner and is approximately one inch in length. The toggling arm 80 is relatively narrow in its entire length but is relatively wide at its base where it begins its downwardly projection. This provides the toggling arm 80 with rigidity during motion along its path of movement. Reinforcing bars 188, 190 add strength and rigidity not only in the path of motion but in the direction perpendicular to it as well. They run the vertical length of the toggling arm 80 up to the spring notch 91.

Figure 16A:
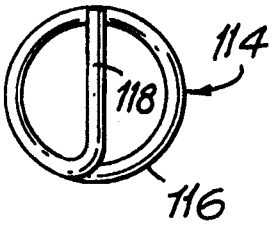
FIG. 16A is a top view of the toggle spring.
Figure 16B:
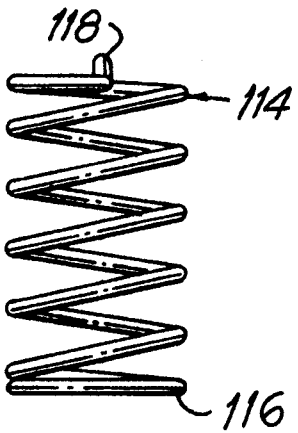
FIG. 16B is a side view of the toggle spring.

The spring notch 91 at the tip of toggling arm 80 provides a means for holding toggle spring 114 in place. The toggle spring 114 is shown in FIGS. 16A and 16B. Beveled tips 90, 94 located on the tip of the toggling arm 80 guide the insertion of the straight portion 118 of the toggle spring 114 into the spring notch 91. The notch bump 92, a narrow raised rounded portion located on the inner side of the beveled tip 90, retains the straight portion 118 by providing a tight fit between the beveled tips 90, 94. The bottom surfaces of the reinforcing bars 188, 190 provide the inner notch wall 192 of the spring notch 91. This wall provides a wide area to support and stabilize the straight portion 118 of the toggle spring 114 when the rockers 76 are toggled.

On the underside of the rocker cover 162 are two partially closed off chambers defined by the bumper chamber walls 82, 150 each located symmetrically about the toggling or rocking axis of the rockers 76. The walls project from the side walls 144, 146 starting approximately one third the distance from the end wall 88 and almost in line with the toggling arm 80. They run inwardly towards the center of rockers 76 for approximately ¼ inch and turn towards the end wall 138 to partially enclose an area of approximately ¼ square inch. The walls 82, 150 project from the underside of rocker cover 162 to a height flush with the height of side walls 144, 146. Rubber bumpers 130 are placed within the two bumper chamber walls 82, 150 and serve to cushion the rocker at both ends of its travel during normal switch operation. The bumpers 130 are cylindrical in shape with a diameter of approximately 3/16 inch and a length of approximately ¼ inch. The bumpers 130 are held in place by means of pointed bumper tabs 84 and 152, 154 and 156 and 158 located on the interior sides of bumper chamber walls 82, 150 and pointed bumper tabs 152 and 160 in the inner surfaces of side walls 144 and 146 which serve to slightly compress and tightly grip the bumpers 130.

Figure 5:
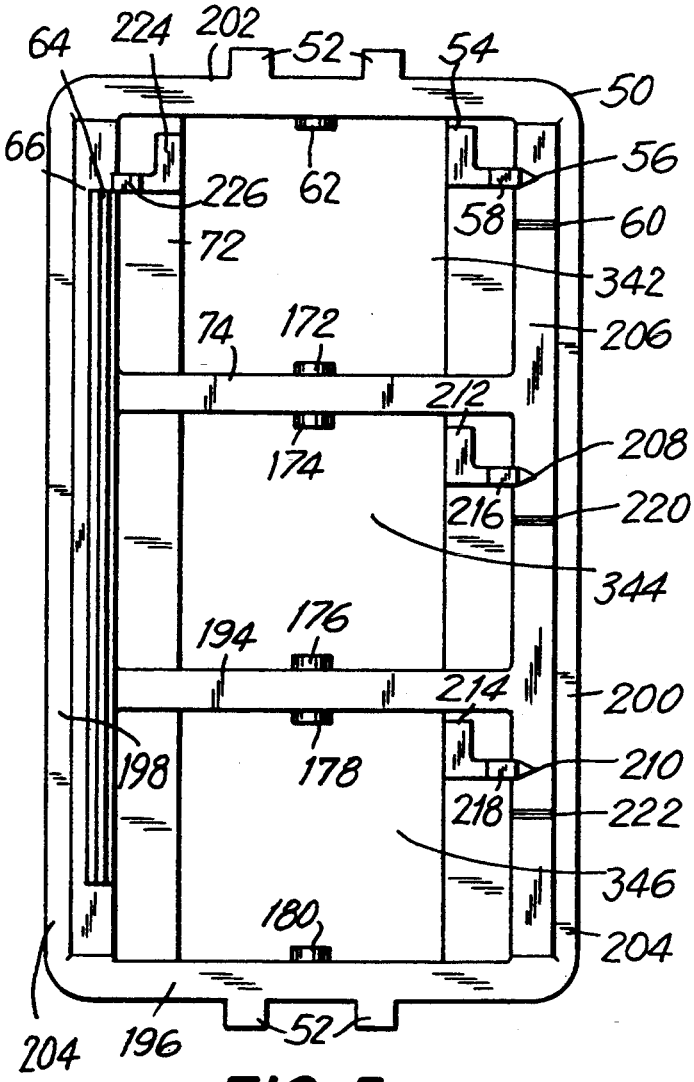
FIG. 5 is a a view of the underside of the cover without the rockers in place.
Figure 6:
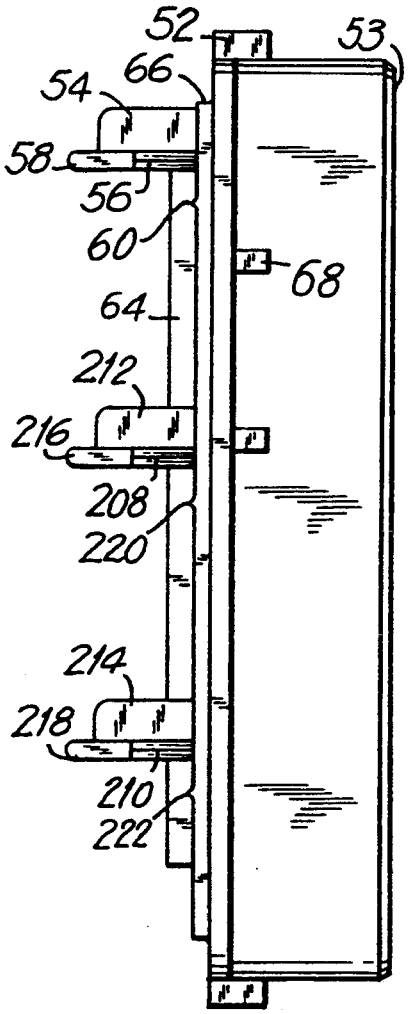
FIG. 6 is a side view of the cover.
Figure 7:
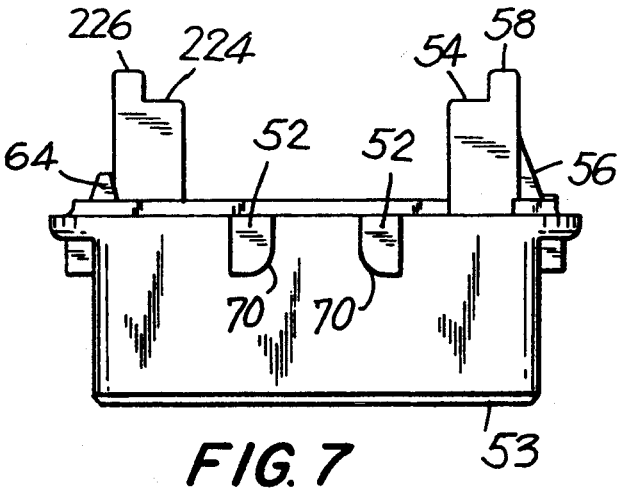
FIG. 7 is an end view of the cover.

Shown in FIGS. 5, 6 and 7, the cover 50 is of rectangular shape overall with a length approximately twice its width and subdivided into three chambers; an upper chamber 342, middle chamber 344 and lower chamber 346. Each chamber is of equal size and rectangular shape having a width approximately twice its length. Final assembly can be of one, two or three switches. The depth of cover 50 is sufficient to incorporate the majority of the body of rockers 76 within its upper and lower borders. The outer surfaces of cover walls 196, 198, 200, 202 are smooth and flat with roundness at their upper edges and at their interfaces with each other. When the switch 10 is installed in a mounting receptacle with a switch cover installed, only the top surfaces of the cover walls 196, 198, 200, 202 are visible. Rockers 76 are normally positioned within these three chambers and connect to the cover 50 by means of pivots 62, 172,

174, 176, 178, 180. These pivots are aligned on a vertical axis running from the midpoint of the top cover wall 202 to the midpoint of the bottom cover wall 196. The two pivots 62, 172 supporting the upper rocker are located on the inner surface of the top cover wall 202 at its midpoint and on the top surface of the upper rocker partition 74, also at its midpoint, respectively. The two pivots 174, 176 supporting the middle rocker are located on the bottom surface of the upper rocker partition 74 at its midpoint and on the top surface of the top rocker partition 194 at its midpoint respectively. The two pivots 178, 180 supporting the lower rocker are located on the bottom surface of the lower rocker partition 194 at its midpoint and on the top surface of the bottom cover wall 196 at its midpoint respectively.

Figure 17:
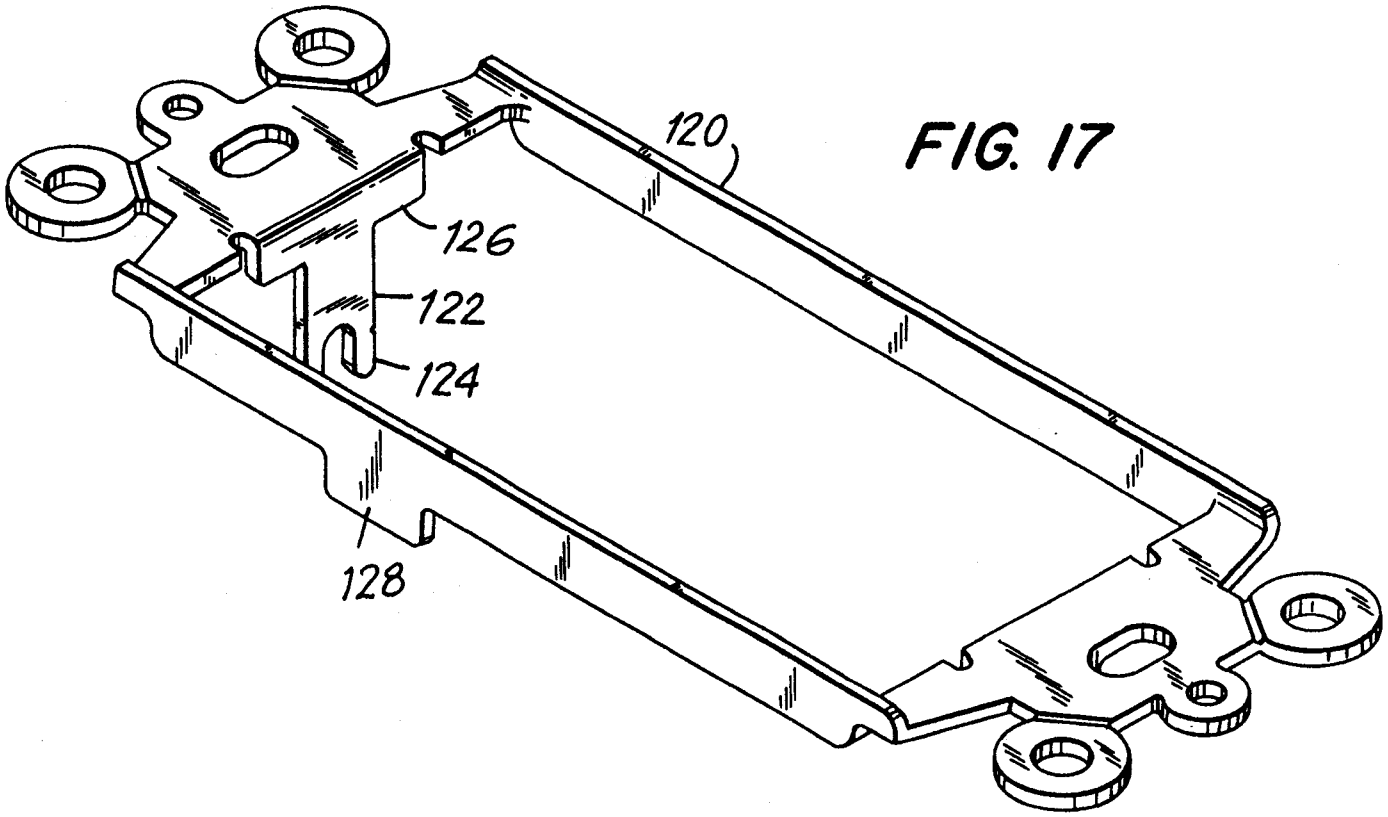
FIG. 17 is an elevational perspective view of the mounting strap.

The cover 50 normally mates flush with base 12 along the lower surfaces of cover walls 196, 198, 200, 202. To keep the cover 50 securely fastened to the base 12, a stamped steel mounting strap 120, shown in FIG. 17, clamps the two parts together. Situated at points equally spaced about a central vertical axis running the length of the cover 50 are strap tab guides 52 spaced apart a distance approximately one third the width of cover 50. One pair of strap tab guides 52 is situated on the outer surface of the top cover wall 202 and another pair on the outer surface of the bottom cover wall 196. These strap tab guides 52 are rectangularly shaped projections that extend out from the outer surfaces of the top and bottom cover walls 202, 196. The strap tab guides 52 begin flush with the lower surface edge of top and bottom cover walls 202, 196 and extend upwardly to a height approximately two thirds of the height of the wall. Guide edges 70, located on the top inside corner of each strap tab guide 52, present a smooth rounded corner for the insertion of strap tabs 122. The strap tab guides 52 and the guide edges 70 provide the guidance for proper insertion of the strap tabs 122 which pass between them during the assembly process.

A pair of strap stops 68, located at the interface between the outer cover wall 200 and the cover flange 204, provides one means of setting the proper standoff distance of the mounting strap 120 and the cover flange 204. A rectangularly shaped strap key 128 projects downwardly from one of the long narrow portions of the mounting strap 120 and fits in the space between the pair of strap stops 68. This arrangement prevents the mounting strap 120 from being attached to the cover 50 in an incorrect, reverse manner. A third strap stop 68 is located at the interface of the other outer cover wall 198 and the cover flange 204, one third of the distance up from the bottom of the outer cover wall 198. This third strap stop 68 serves a similar purpose to the pair just described by providing another means of positioning the mounting strap 120 properly.

Situated within each of the three chambers, defined by the upper and lower rocker partitions 74, 194 respectively, are a pair of elongated rectangularly shaped rocker stops 72. These stops are flat smooth ledges approximately ¼ inch wide that run the length of each chamber. Located near the lower edge of the cover 50, the rocker stops 72 extend from the outer cover walls 198, 200 and are integral with the upper and lower rocker partitions 74, 194.

The following items are described from a viewpoint looking at the underside of the cover 50 in an inverted position above the inverted cover 50. To assure that the cover 50 is aligned properly with the base 12, the cover 50 has a pair of long thin alignment strips 66, 206 that extend upwardly from the lower surface of each of the outer cover walls 198, 200. The alignment strips 66, 206 run almost the full length of each of the outer cover walls 198, 200 and lie almost at the edge of the cover flange 204. Approximately one eighth inch wide, the smooth flat strips normally extend slightly below the top inner surface of the base walls when the cover 50 is placed on the base 12. A long thin raised rail 64 rims for most of the length of alignment strip 66 to within a quarter inch of the strip's ends. The inner edge of the raised rail 64 is flush with the inner edge of the alignment strip 66. The rail projects upward from the alignment strip 66 approximately ⅛ inch and is shaped like an inverted 'V' with a smoothed edge at its apex. This rail serves to properly align the brush assembly 112 during assembly and to keep the brushes positioned correctly during normal operation of the switch. During the assembly operation, as the cover 50 is positioned on top of the base 12, the pointed apex of the raised rail 64 contacts the top surface of the brush assembly 112 and forces it to seat against the lower floor of the base 12.

Similarly, integral with the alignment strip 206 are three alignment ramps 56, 208, 210 that are evenly spaced from each other and serve to align the three terminal assemblies 96 in the base 12 during the assembly process as the cover 50 is fit onto the base 12. Rectangular posts 54, 212, 214 project upwardly from the lower surface of the cover 50 a distance of approximately ⅜ inch. With a top plan view (see FIG. 5) of the lower surface of the cover 50, the rectangular posts are located in the top right hand corner of each rectangularly shaped switch chamber 342, 344, 346. Similarly, a fourth rectangular post 224 is located, in the top left hand corner of the upper chamber 342. The width of each post is approximately one half its length, and the inner side of each post is flush with the inward edge of each of the rocker stops 72 that lie along the outer cover wall 200. The top ends of the rectangular posts 54, 212, 214, 224 normally lie close to or touch the upper surface of the terminal partitions 26, 294, 296 and brush partitions 350, respectively (see FIG. 13). These posts serve as added support for the cover 50 when it is in position over the base 12. Situated at the top ends of the rectangular posts 54, 212, 214, 224 are the thin elongated push stops 58, 216, 218, 226 respectively. These stops are ⅛ inch high extensions of the rectangular posts, projecting upwardly from the outer half of each post and are much smaller in length than width. When normally extended down into the base 12, the push stops lie approximately ¼ inch above the ends of the clamp arm 100 on the three terminal assemblies 96, and the clamp arm 230 on the brush assembly 112. If, during the removal of a wire from the terminal assembly or brush assembly, the clamp arm is extended too far into the base 12, the push stops 58, 216, 218, 226 prevent the terminals from being overextended and permanently damaged. The stops do not allow the terminals to be bent beyond a point where the terminal would not return all the way to its original position when released.

Projecting upwardly from the alignment strip 206 are three lateral ridges 60, 220, 222 evenly spaced apart from each other with each ridge positioned midway within each rectangularly shaped chamber. Each short inverted V-shaped ridge extends slightly less than the width of alignment strip 206 and is centered within it. These ridges serve to clamp each of the three terminal assemblies 96 down firmly and keep them in proper position as the cover 50 is assembled onto the base 12.

Figure 8:
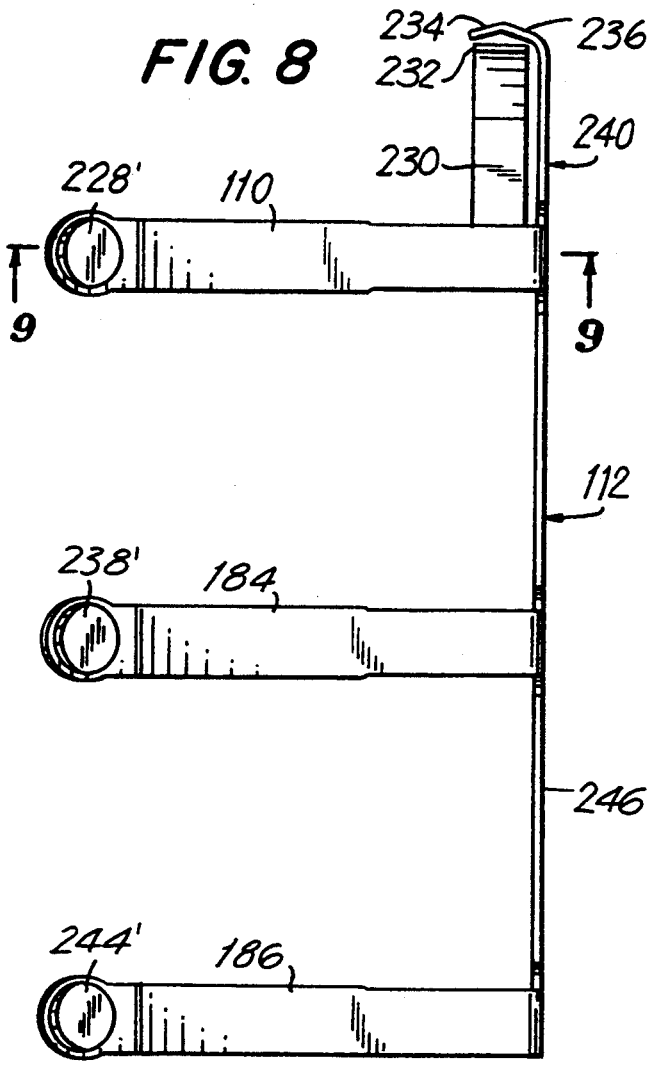
FIG. 8 is an elevational view of the brush assembly.
Figure 10:
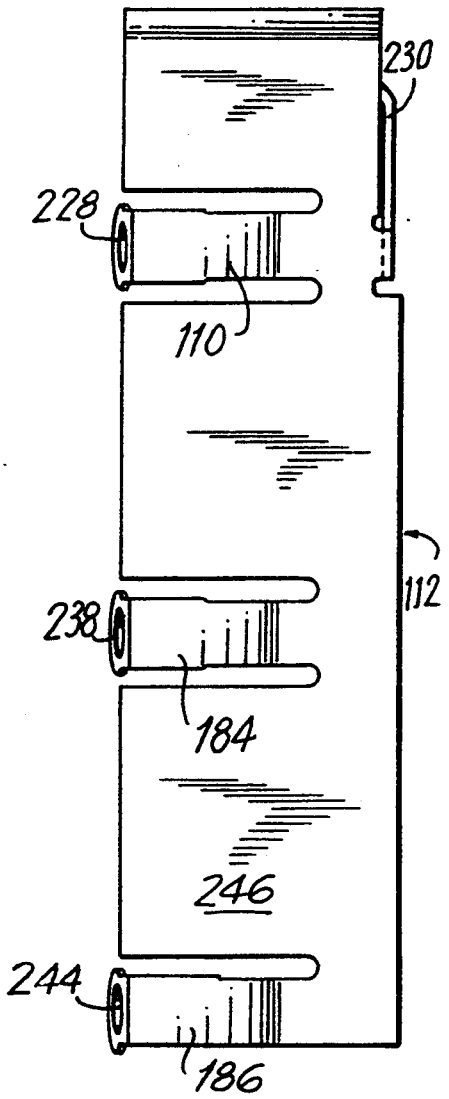
FIG. 10 is a side view of the brush assembly showing the brush arms.
Figure 9:
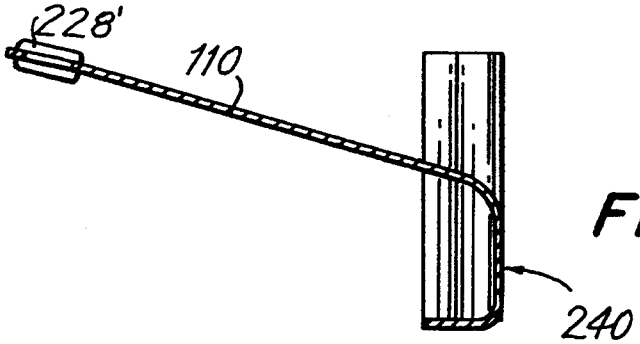
FIG. 9 is a sectional view taken on the line 9—9 of FIG. 8.

We turn now to a discussion of the brush assembly 112 and terminal assembly 96. The brush assembly 112, shown in FIGS. 8, 9 and 10, is largely rectangularly shaped, incorporating three brush arms 110, 184, 186 and a wire fastening device. The brush assembly 112 is made from a single piece of suitable stamped metal with contacts riveted to the end of each brush arm. The three brush arms 110, 184, 186 are formed from the stamping process and bent downward to produce arms approximately one inch long. The brush arms 110, 184, 186 are about 3/16 inches in width and are thin flat extensions of the brush backplate 246 that extends outwardly from it. The three brush arms begin approximately one third of the way up from the lower surface of the backplate 246. They travel upwardly, parallel with the backplate 246, until its midway point. The arms then bend approximately 75° down from the vertical and continue in a straight path for approximately one inch. The last ¼ inch of the arms are bent further downward at an approximate angle of 5½° with respect to the plane that extends along the major portions of brush arms 110, 184 and 186 (see FIG. 10). The arms are circular for the last ⅛ inch with holes 228, 238, 244 centered in the circular portions of these arms. Into these holes 228, 238, 244, respectively, are placed silver alloy contacts 228', 238' and 244' which are riveted to the respective arms 110, 184 and 186 ( see FIGS. 8 and 9). The contacts 228', 238', 244' consist of a copper base with a conductive material layer bonded to this base. This conductive material layer, silver alloy, for example, allows currents of 10 to 20 amperes to be carried without excessive heat generation, electrical losses or excessive arcing, thereby prolonging the life of the switch.

The brush arm 186 lies on the bottom end of the brush assembly 112. The top end of the brush arm consists of a terminal fastening device. Extending inwardly from the lower surface of the backplate 246 is the clamping arm 230. Formed from stamping, the clamping arm 230 is subsequently bent upward so that the arm lies flat in the horizontal plane. The arm is connected to the backplate assembly 112 at a point directly below the brush arm 110 and has a width of approximately ⅛ inch. It extends approximately ⅜ inch towards the top portion of the brush assembly and then bends upwardly at an angle of approximately 30° from the horizontal.

A portion of the terminal fastening device is formed from outer bend 234 and the inner bend 236. These bends form a clamping surface for a wire conductor inserted into the terminal fastening device. The inner bend 236 is an extension of the top portion of the clamping wall 240. The clamping wall 240 is integral with the brush backplate 246, lying in the same vertical plane as the brush backplate 246. The inner bend 236 is formed by bending, from the upper to lower edges, the top portion of the clamping wall 240 at a distance approximately ¼ inch from the top edge of the clamping wall 240. The inner bend is bent approximately 75° from the plane of the clamping wall 240. A second bend, approximately ⅛ inch from the top edge of the clamping wall 240 and extending from the upper to lower edges of the damping wall 240, forms the outer bend 234. This outer bend 234 is bent approximately 30° from the plane of the inner bend 236. The area of the outer bend 234 formed is slightly less than that of the inner bend 236.

Inserted into the terminal fastening device, a wire conductor is normally positioned vertically in the inner area formed by the intersection of the outer and inner bends 234, 236 respectively. The intersection of the inner bend 236 and outer bend 234 forms a 150° angle. A wire conductor inserted into the terminal fastening device normally lies in this bend where it makes a better electrical connection with the brush assembly 112 than if the clamp wall 240 was flat. A wire conductor enters the terminal fastening device in the area of the lower surface of the clamp bend 232 and the lower portion of the clamp wall 240. As the wire conductor is inserted, it contacts the clamp bend 232 at its edge portion and pushes the clamp arm 230 in an upward direction. After full insertion, the wire conductor resides wedged between the clamp bend 232 and the clamp wall 240. The top edge of the clamp bend 232 bites into the wire conductor due to the force exerted by the spring action of the clamp arm 230. The force from the spring holds the wire conductor tightly against the inner side of the clamp wall 240 and provides for a good electrical connection between the brush assembly 112 and the wire conductor.

As the wire conductor normally lies pressed between the clamp bend 232 and the clamp wall 240, it is surrounded on its lower and inner sides by the rectangular post 224. When the cover 50 is properly mounted on top of the base 12, the rectangular post 224 forms a long narrow rectangular volume, providing a rigid barrier confining the wire conductor.

It is difficult to remove the wire conductor by simply pulling it due to the lower edge of the clamp bend 232 biting into it further as it is pulled. An instrument or tool can be inserted through the rectangular release openings 24, 248, 250 in the base 12 (See FIG. 13) and used to push the clamp arm 230 upward. As the clamp arm 230 is pushed upward, pressure diminishes against the wire conductor, allowing it to be pulled freely out of the base 12.

The brush arms 110, 184, 186 are formed such that they can be flexed approximately plus or minus 10° without being permanently deformed. The actuating portion 148 of the rockers 76 contact the midportion of each of the brush arms 110, 184, 186. Each brush arm has a range of motion of approximately 10° from the normal on to off positions of the rockers 76.

Figure 11:
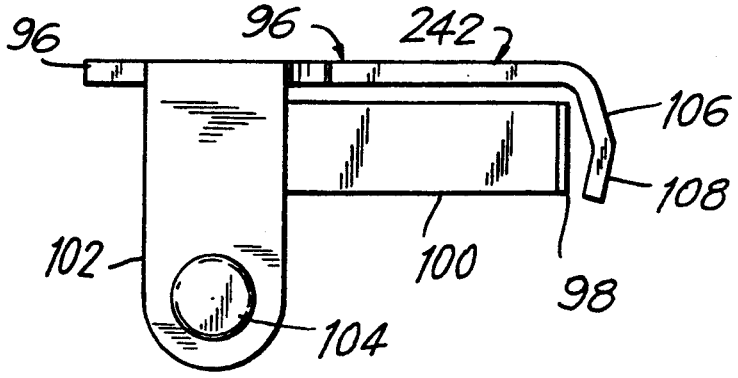
FIG. 11 is a top elevational view of the terminal assembly.
Figure 12:
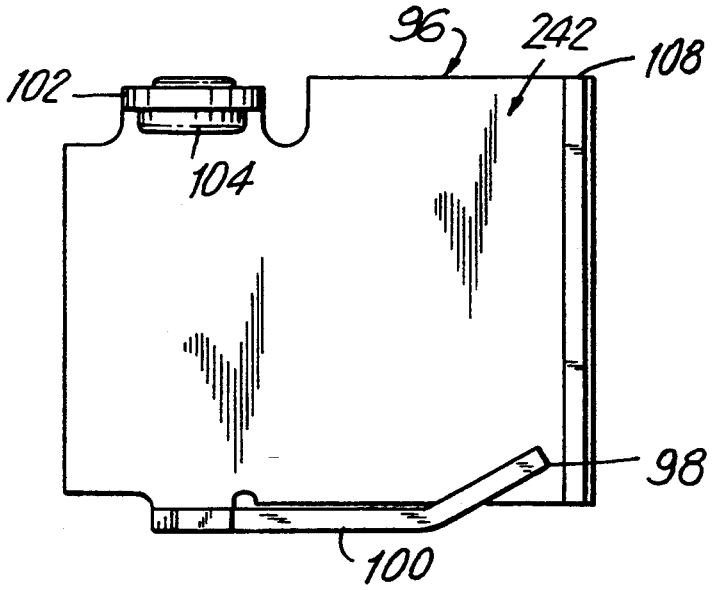
FIG. 12 is a side view of the terminal assembly.

The switch 10 incorporates three terminal assemblies 96, as shown in FIGS. 11 and 12, that receive one wire conductor each, one for each of the circuits controlled by the switch. Each terminal assembly 96 consists of a wire fastening device, clamp wall 242, contact arm 102 and contact 104. The clamp wall 242 has an area of approximately ⅜ square inches. The terminal assembly 96 is stamped from sheet metal with various portions of it bent to form various functional structures of the assembly. The terminal assembly 96 is stamped from a heavier gauge metal than that of the brush assembly 112. This is because the brush assembly 112 has portions of it that need to flex during opening and closing of the switch. The terminal assembly 96, however, has no such flexibility requirement and remains rigid in normal operation.

The contact arm 102 is a ⅜ inch long projection situated at right angles to the clamp wall 242. The arm is bent so as to lie along the upper edge of the clamp wall 242 closer to its bottom portion. The contact arm 102 is approximately 3/16 inch in height and ¼ inch in width. The surface is flat and smooth in texture with the inner end of the contact arm 102 being a smooth semicircle. The electrical contact 104 is riveted to the contact arm 102 through a hole near the inner end of the contact arm 102. The contact 104 has its electrical contact surface oriented downward in order to meet the contact surfaces 228, 238, 244 of the brush assembly 112 which are oriented upwardly.

The terminal fastening device of the terminal assembly 96 is identical to that of the brush assembly 112. Extending inwardly from the lower surface of the clamp wall 242 is the clamp arm 100. The clamp arm 100 is formed from stamping and the resulting arm is subsequently bent upward so that the arm lies flat in the horizontal plane. The arm projects to the backplate 242 at a point directly below the contact arm 102 and has a width of approximately ⅛ inch. It extends approximately ⅜ inch towards the top portion of the brush assembly and then bends upwardly at an angle of approximately 30° from the horizontal.

A portion of the terminal fastening device is formed from outer bend 108 and the inner bend 106. These bends form a back clamping surface for a wire conductor inserted into the terminal fastening device. The inner bend 106 is an extension of the top portion of the clamping wall 242. The inner bend 106 is formed by bending, from the upper to lower edges, the top portion of the clamp wall 242 at a distance approximately ¼ inch from the top edge of the clamp wall 242. The inner bend is bent approximately 75° from the horizontal plane of the clamp wall 242. A second bend, approximately ⅛ inch from the top edge of the clamp wall 242 and extending from the upper to lower edges of the clamp wall 242, forms the outer bend 108. This outer bend 108 is bent approximately 30° from the plane of the inner bend 106. The area of the outer bend 108 thus formed is slightly less than that of the inner bend 106.

Inserted into the terminal fastening device, a wire conductor is normally positioned vertically in the inner area formed by the intersection of the outer and inner bends 108, 106 respectively. The intersection of the inner bend 106 and outer bend 108 forms a 150° angle. A wire conductor, inserted into the terminal fastening device, lies in this bend and has a better electrical connection with the terminal assembly 96 than if the clamp wall 242 was flat. A wire conductor enters the terminal fastening device in the area of the lower surface of the clamp bend 98 and the lower portion of the clamp wall 242. As the wire conductor is inserted, it contacts the clamp bend 98 at its edge portion and pushes the clamp arm 100 in an upward direction. After full insertion, the wire conductor resides wedged between the clamp bend 98 and the clamp wall 242. The top edge of the clamp bend 98 bites into the wire conductor due to the force exerted by the spring action of the clamp arm 100. The force from the spring holds the wire conductor tightly against the inner side of the clamp wall 242 and provides for a good electrical connection between the terminal assembly 96 and the wire conductor.

As the wire conductor normally lies pressed between the clamp bend 98 and the clamp wall 242, it is surrounded on its lower and inner sides by one of the rectangular posts 54, 212, 214. When the cover 50 is properly mounted on top of the base 12, the rectangular posts 54, 212, 214 combine to form a long narrow rectangular space, thus providing a physical barrier confining the wire conductor.

Removal of the wire conductor by pulling on it is difficult, because the lower edge of the clamp bend 98 bites further into the wire conductor. An instrument or tool can be inserted through the respective rectangular release openings 24, 248, 250 in the base 12 and used to push the clamp arm 100 upward. As the clamp arm 100 is pushed upward, pressure diminishes against the wire conductor, allowing it to be freely pulled out of the base 12.

The damp arm 100 is formed by stamping an L-shaped tab from the clamp wall 242 and bending it 90° upward so its surface lies in the horizontal plane at right angles to the clamp wall 242. The tab projecting inwardly from the lower bottom corner of the clamp wall 242 is approximately ⅛ inch wide. The projecting tab makes a right angle turn towards the top of the terminal assembly 96 and extends alongside the lower edge of the clamp wall 242 for approximately ⅜ inch. From there it extends upwardly a distance of approximately 3/16 inch after a 30° upward bend.

Figure 13:
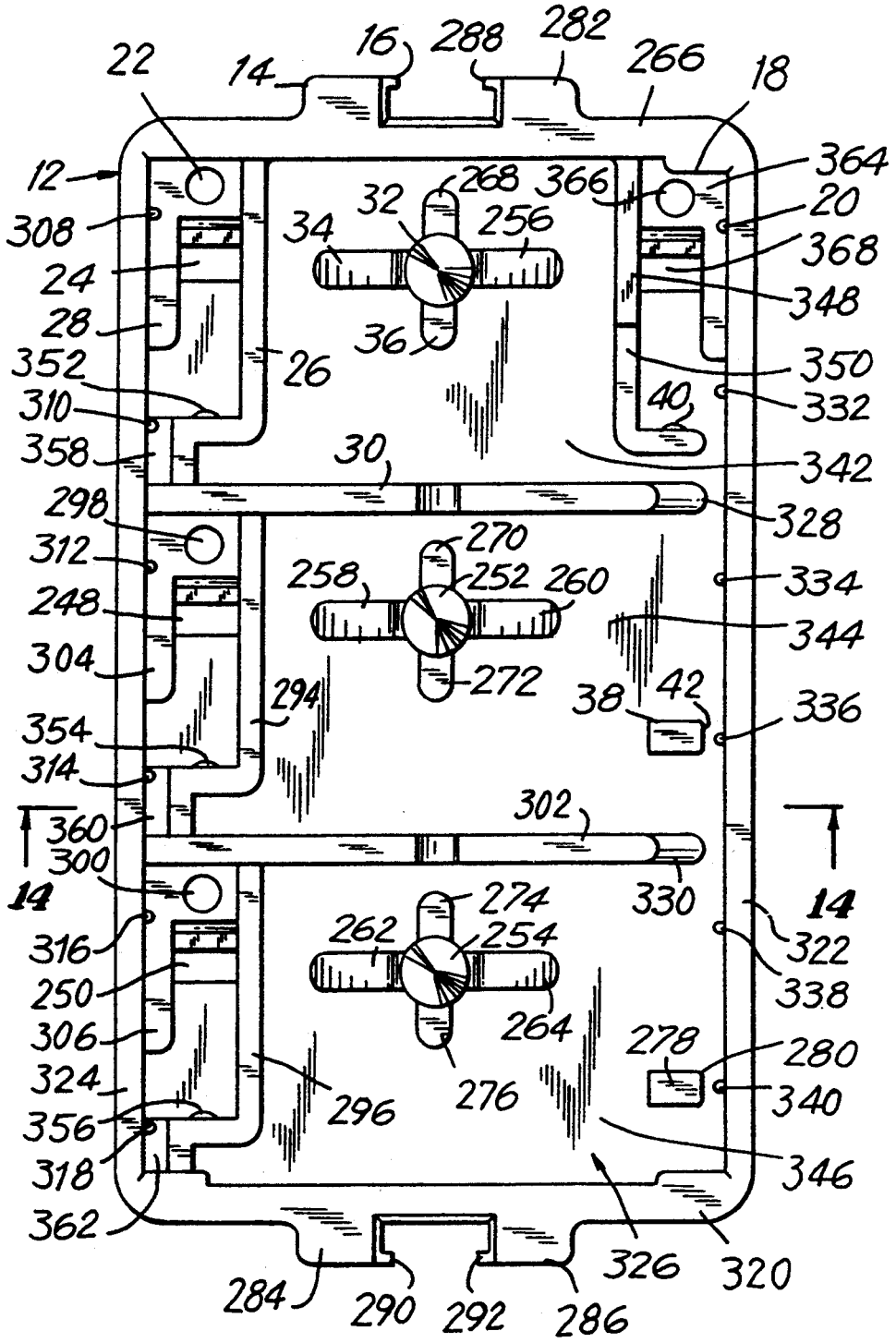
FIG. 13 is an elevational view of the base without the terminal or brush assemblies.
Figure 14:
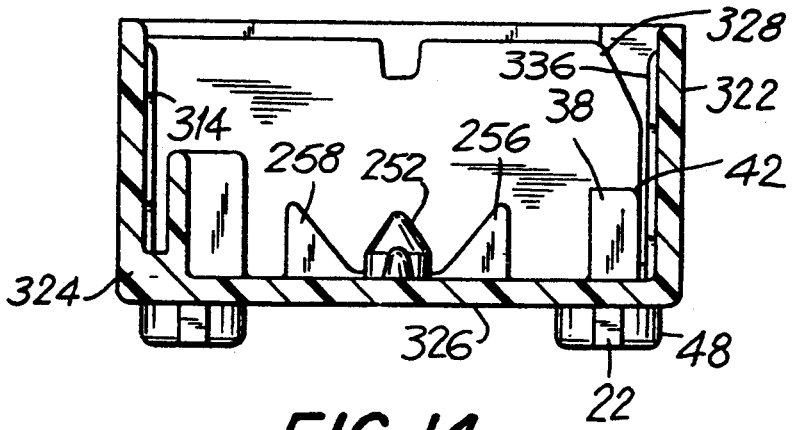
FIG. 14 is a sectional view taken on the line 14—14 of FIG. 13.
Figure 15:
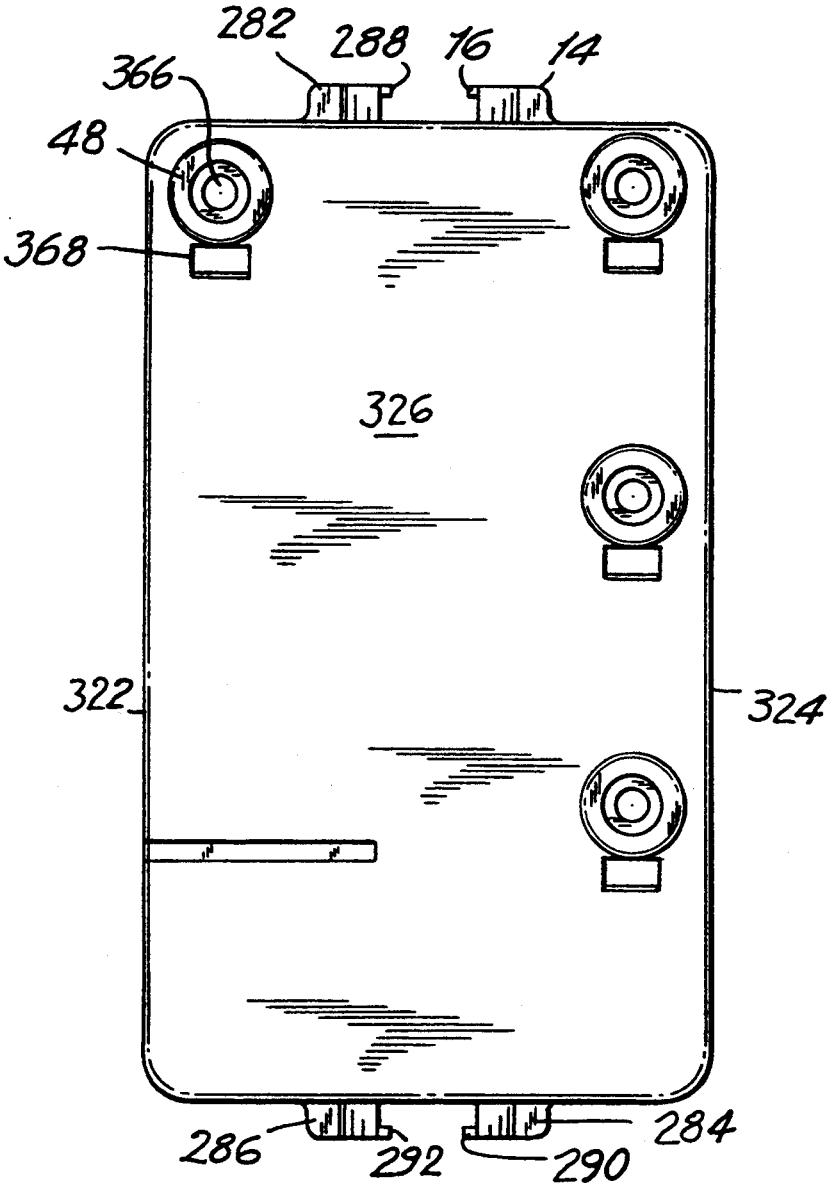
FIG. 15 is a bottom view of the base.

Shown in FIGS. 13, 14 and 15, the base 12 is a rectangularly shaped enclosure consisting mainly of four outer walls enclosing a space which is partitioned into three switch chambers. The respective lengths of the two side walls 322, 324 are approximately twice that of the top wall 266 and the bottom wall 320. The outer surfaces of all four walls are smooth and flat and joined with smoothly curved corners. Within the four walls of the base 12 lie most of the components making up the switch. The base 12 houses the terminal assemblies 96, the brush assembly 112, a majority of the rockers 76, the toggle spring 114 and the mounting strap 120 and also seats the cover 50.

The strap tab guide bodies 14, 282 and 284, 286 are located respectively on the top wall 266 and the bottom wall 320. On both the top wall 266 and the bottom wall 320, the strap tab guide bodies 14, 282 and 284, 286, respectively, are centered, approximately ¼ inch apart, around the midpoint of each wall. The innermost surfaces of the upper guide bodies 114, 282 are flush with the upper surface of the base 12 and extend approximately ¼ inch therefrom, and the innermost surface of the lower guide bodies 290 and 292 are flush with the lower surface of the base 12 and extend approximately ¼ inch therefrom. The guide bodies project out from the surface of the top and bottom walls 266, 320 approximately ⅛ inch. The strap tabs 122 are normally inserted between the two strap tab guide bodies 14, 282 and 284, 286 on the top and bottom walls 266, 320 respectively. The four guide bodies are rectangular in shape with straight diagonal lower inner corners. The strap tabs 122 and the strap tab tangs 124 pass through the strap tab guides 52 on the cover 50 when it is seated properly on the base 12. The strap tab tangs 124 are bent during assembly, against the diagonal corners of the strap tab guide bodies 14, 282, 284, 286 and serve to fasten the mounting strap 120 to the base 12. The strap tab guide guards 16, 288, 290, 292 further guide and help in the proper placement of the strap tabs 122 between the strap tab guide bodies 14, 282, 284, 286. The strap tab guide guards 16, 288, 290, 292 are thin vertical flanges projecting from the inner vertical walls of the strap tab guide bodies 14, 282, 284, 286 respectively. These guide guard flanges project inwards and are approximately 1/16 inch wide and approximately 1/32 inch thick.

The inner space of the base 12 is partitioned into upper, middle and lower chambers 342, 344, 346 respectively, separated by an upper unit partition 30 and a lower unit partition 302. Both these partition walls are integral with the left side wall 324 and extend perpendicularly substantially across the width of the base 12 towards the right side wall 322. The partition walls are approximately 1/16 inch thick and have mainly smooth flat surfaces. Integral with the base floor 326 and the left side wall 324, the partitions extend vertically upward to a height just below the upper surface of the base 12. The right vertical edge of the partitions 30, 302 lie approximately 1/16 inch from the right side wall 322. The upper right corners of both partitions 30, 302 have diagonal edges 328, 330 respectively to assist in the proper insertion of the brush assembly 112.

In the space between the partitions 30, 302 and the right side wall 322, lies the brush assembly 112. In addition to the right edge of both partitions 30, 302, two brush posts 38, 278 lie on the inner side of the brush backplate 246. The brush post 38 is located approximately 1/16 inch inwardly from the right side wall 322 and vertically, two thirds of the way downwardly within the middle switch chamber 344. The other brush post 278 is situated similarly in the lower switch chamber 346. Both posts are identically shaped rectangular projections rising approximately ¼ inch upwardly from the base floor 326. Brush post corners 42, 280 lie on the upper outer corners of brush posts 38, 278 respectively. The smoothly rounded corners assist in the insertion of the brush assembly 112 during the assembly process.

Equally spaced along the inner side of the right side wall 322 are brush guides 20, 332, 334, 336, 338, 340. These guides are thin strips that run vertically from the base floor 326 to approximately ⅛ inch below the upper surface of the right side wall 322. Projecting outwardly approximately 1/32 inch, the brush guides serve to keep the brush assembly 112 a sufficient distance from the right side wall 322. The brush assembly 112 normally is wedged between the upper and lower unit partitions 30, 302 and the brush posts 38, 278 on the inner side, and the brush guides 20, 332, 334, 336, 338, 340 on its outer side. The brush guides provide a tight fit for the brush assembly 112 during the insertion process. Being thin plastic rails, the guides are soft enough to be deformed as the brush assembly 112 is placed in position within the base 12. The base 12 is molded to provide a space slightly smaller than the width of the brush assembly 112. As it is inserted, the brush guides are distorted in shape to accommodate the width of the brush assembly 112.

Within the upper, middle and lower chambers 342, 344, 346, there is a terminal partition comprising portions 26, 294, 296, respectively, that serves to physically section off the terminal assembly 96 located within each chamber. The partitions provide physical and electrical isolation between the terminal assemblies 96 and other components located in each chamber. Each terminal partition is a smooth flat vertical wall that extends from the top of the chamber to the bottom of the chamber. The three terminal partitions 26, 294, 296 are located in similar positions within their respective chambers. All three have an equal height of approximately ⅜ inches. In the upper chamber 342, terminal partition 26 is connected to the top wall 266 at a point approximately ¼ inch inward from the side wall 324. The partition wall extends directly downward in a direction parallel to the side wall 324 until approximately ⅛ inch from the upper unit partition 30, where it turns at right angles outwardly towards the side wall 324. After approximately ⅛ inch the terminal partition 26 turns at right angles downward again and runs parallel to the side wall 324. The terminal partition 26, within the upper chamber 342, extends downwardly for approximately ⅛ inch where it connects to the upper unit partition 30 at a distance of approximately ⅛ inch inward from the side wall 324. The terminal partition 294, within the middle chamber 344, extends in an identical fashion to terminal partition 26, from a point approximately ¼ inch from the side wall 324 on the upper unit partition 30 to a point approximately ⅛ inch from the side wall 324 on the lower unit partition 302. Within the lower chamber 346, the terminal partition 296 extends in an identical manner to terminal partitions 26, 294 from the lower unit partition 302 to the bottom wall 320.

Terminal guides situated along the side wall 324 are structures similar to the brush guides 20, 332, 334, 336, 338, 340 located on the side wall 322. The terminal guides 308, 310 are located in the upper chamber 342; the terminal guides 312, 314 are located in the middle chamber 344; and the terminal guides 316, 318 are located in the lower chamber 346. Within each chamber, each terminal guide is situated on the inner side of the side wall 324 and spaced approximately 3/16 inch from the top and bottom perimeter of the chamber. Similar in form to the brush guides, the terminal guides 308, 310, 312, 314, 316, 318 run vertically from the base floor 326 to within approximately ⅛ inch of the upper surface of the base 12 side wall 324 edge. These terminal guides serve to keep the terminal assemblies within each chamber a sufficient distance from the inner surface of the side wall 324.

Located along the vertical outer side of the terminal partitions 26, 294, 296 are the terminal wedges 352, 354, 356. These wedges lie centered on the portion of the terminal partition that lies in the horizontal plane. The wedges are identically placed respectively within each of the three chambers 342, 344, 346. Each wedge is a ramp, integral with the terminal partitions, that start approximately ⅛ inch from the upper edge of the terminal partition and project linearly to its base integral with the base floor 326. Each wedge serves to guide or orient the terminal assemblies 96 as they are inserted during manufacture.

Similarly to the terminal partitions, the brush partition 350 serves to insulate the brush assembly 112 terminal both physically and electrically from the other components in the upper chamber 342. The brush partition 350 is a smooth flat wall extending from the inner side of the top wall 266 inward approximately ¼ inch from the wall. The partition extends downwardly parallel to the side wall 322 to approximately ⅛ inch from the upper unit partition 30 where it makes a right angle outwardly towards the side wall 322. It continues in the horizontal plane for approximately ¼ inch and, unlike the terminal partitions, stops approximately 1/16 inch from the inner surface of the side wall 322. The partition extension 348 brings the height of the brush partition 350 slightly above that of the terminal partitions. This partition extension 350 extends from the top wall 266 approximately three eighths of the way down, where the height of the brush partition 350 drops lower to approximately ¼ inch high. Similar to the wedges on the terminal partitions, the brush wedge 40 lies on the outer surface of the horizontal portion of the brush partition 350. The ramp-like brush wedge 40 begins to taper from the upper edge of the brush partition 350 and projects linearly downward until it meets integrally with the base floor 326.

Within the area adjacent to the side wall 324, sectioned off by the terminal partitions 26, 294, 296, and integral with the base floor 326 are raised portions 28, 304, 306 and terminal ledges 358, 360, 362, one raised portion and one terminal ledge being situated in the upper, middle and lower chambers 342, 344, 346 respectively. The raised portions and terminal ledges project upwards from the base floor 326 approximately 1/16 inch. The recess or depression formed by the raised portions and terminal ledges fits the clamp arm 100 of the terminal assembly 96 when it is placed in the base 12. This allows the terminal assembly 96 to seat flush with the lower surface of the base 12. The lower portion of the inner bend 106, outer bend 108 and a portion of the clamp wall 242 rest on the upper surface of the raised portions 28, 304, 306. The lower bottom portion of the clamp wall 242 normally rests on the upper surface of the terminal ledge 358, 360, 362. Similarly, raised portion 364 is located in the top right corner of the upper chamber 342. The recess created by the projection of the raised portion 364 and the brush partition 350 fits the clamping arm 230 of the brush assembly 112.

Within each area on the inner side of the side wall 324, enclosed by the terminal partitions 26, 294, 296 and the area on the inner side of the side wall 322 and the brush partition 350 are two openings through the base floor 326. Two wire holes 22, 366 located in the upper chamber 342 and two wire holes 298, 300, located one each in the middle and lower chambers 344, 346 respectively, provide an opening for the insertion of a wire conductor that is inserted into the switch 10 and connected to the terminal assemblies 96. These wire holes 22, 298, 300 are situated in the top left corner within each chamber. Directly below these wire holes are release openings 24, 248, 250 that provide access for a tool to release a wire conductor that has previously been inserted into the switch 10. The wire holes 22, 298, 300 are circular with a diameter of approximately $\frac{1}{8}$ inch. The release openings 24, 248, 250 are rectangular in shape with a width approximately twice that of its length.

We now turn to a discussion of the rockers' respective pivoting mechanisms. As discussed previously, the rockers 76 are snap fit onto pivots 62, 172, 174, 176, 178, 180 located on the cover 50 through pivot holes 86. This arrangement allows the rockers 76 to swing through an arc of approximately 10° between the on and off positions of the switch 10. The straight portion 118 of the toggle spring 114 is attached to the spring notch 91 of the toggling arm 80. The lower portion of the toggle spring 114 rests on upward projections integral with the base floor 326 (See FIGS. 13 and 14). These projections are located on the base floor 326 centrally about an axis running the length of the switch 10 and in the top third of each chamber. The toggle spring 114 mechanism is configured around a centrally located spring pivot 32, 252, 254 one of these pivots in each of the upper, middle and lower chambers 342, 344, 346 respectively. These spring pivots are vertical cylinders with a diameter of approximately 3/16 inch and a height of 1/16 inch rising perpendicularly to the base floor 326. The spring pivots continue rising for approximately another 1/16 inch and converge to a point at its apex, forming a smooth cone. The toggle spring 114 normally sits on top of this spring pivot 32, 252, 254, held at a height of the base of the cone portion of the spring pivot. Rectangularly shaped top spring rests 268, 270, 274 are approximately 1/16 inch high projections integral with the top portion of the spring pivot 32, 252, 254, respectively. Similarly, the rectangularly shaped bottom spring rests 36, 272, 276 are approximately 1/16 inch high projections integral with the bottom portion of the spring pivot 32, 252, 254, respectively. Both the top and bottom spring rests project upwardly from the base floor 326 to a height flush with the base of the cone portion of the spring pivot 32, 252, 254. These top and bottom spring rests serve to space apart the toggle spring 114 from the base floor 326.

Similarly located, integral with the spring pivot, are spring stops 34 and 256, 258 and 260, 262 and 264, each pair being within the upper, middle and lower chamber 342, 344, 346, respectively. Each pair of spring stops are located one each on either side of the spring pivot, along an axis running from the side wall 324 to the side wall 322. Each spring stop is a ramp-shaped projection extending outwardly from the spring pivot approximately $\frac{1}{4}$ inch and rising approximately $\frac{1}{4}$ inch from the base floor 326 at its peak. The ramp angle formed is approximately 45° and the ramp surface faces inwardly. The inwardmost portion of the base of the spring stops 34, 256, 258, 260, 262, 264 is flat in the horizontal plane for approximately 1/32 inch before it meets the spring pivot 32, 252, 254 at a height just slightly higher than the base floor 326. The lower extension of the base of the spring stops 34, 256, 258, 260, 262, 264 and the upper extension of the spring rests 268, 36, 270, 272, 274, 276 allow space for the flat end 116 of the toggle spring 114 when the rockers 76 are in their on and off positions.

With the rockers 76 and cover 50 in their normal operating positions, the side portion of the toggle spring 114 lies along the flat ramp surface of either of the two spring stops 34 and 256, 258 and 260, 262 and 264 located within the upper, middle and lower chamber 342, 344, 346, respectively. There are two resting positions of the rockers 76 that correspond to on and off positions of the switch 10. In each of these resting positions, the spring stop retains the toggle spring 114 and supports it. In response to a movement of the rockers 76, the body of the toggle spring 114 moves from its resting position on one of the two spring stops and travels in a vertical plane to the spring stop on the other side of the spring pivot, where it rests along its flat ramp portion. The flat end 116 of the toggle spring 114 remains seated on the upper surface of the spring rests 268, 36, 270, 272, 274, 276 as it moves through its range of travel. The toggle spring 114 is maximally compressed when its vertical axis is parallel with the vertical axis of the spring pivot 32, 252, 254. This compression in the toggle spring 114 provides the snap action feel of the switch 10 as the rockers 76 are moved from the on to off or off to on position. It also serves to retain the rockers 76 in either the on or off position. Thus, force must be exerted on the rocker cover 162 only until the rockers 76 reach their midway point in their travel from the on to off or off to on position. After this point, energy is released from the compressed toggle spring 114 and this potential energy forces the rocker to the end of its travel in a quick snap action manner.

As the rockers 76 are moved to the on or off position, the contacts 228', 238', 244' on the brush assembly 112 make and break electrical contact with the contacts of the terminal assemblies 96. As previously discussed, the activating portion 148 of the actuating arm 182 on the rockers 76 move the brush arm 110, 184, 186 of the brush assembly 112 to effect the making and breaking of the contacts 228', 238', 244' of the brush assembly 112 with the contacts 104 of the terminal assemblies 96.

The embodiments of the invention disclosed and described in the present specification, drawings and claims are presented merely as examples of the invention. Other embodiments, forms and modifications thereof will suggest themselves from a reading thereof and are contemplated as coming within the scope of the present invention.

What is claimed is:

1. An electrical switch comprising:

a housing having a base member and four side walls joined so as to form a rectangle having an open top, said base member having an interior surface;

input means connected to said housing and suitable for direct contact by a user;

actuating means movable in response to movement of said input means; said actuating means comprising an actuating arm integral with said input means;

said actuating arm comprising an actuating portion and a reinforcing portion, said actuating portion effectuating on/off control of said electrical switch in response to said user contact;

toggle means comprising a toggle arm integral with said input means responsive to movement of said input means for retaining said switch in a position caused by said contact by said user;

a toggle spring having a first end and a second end connected to said toggle arm at said first end and to a pin extending from said interior surface of said base member towards said open top of said housing at said second end, said toggle spring which is compressed during the first half of travel of said input means and expands during the second half of travel of said input means;

two spring stops extending upwardly from said interior surface of said base member towards said open top of said housing that support a side portion of said toggle spring at either end of said input means travel;

two spring rests extending upwardly from said interior surface of said base member towards said open top of said housing to support said toggle spring and space said second end of said toggle spring above said interior surface of said base member;

at least one fixed terminal assembly each having a first contact thereon; and a brush assembly comprising at least one movable brush arm, each arm having a second contact thereon, said at least one movable brush arm responsive to movement of said actuating means to cause its associated one of said second contacts to electrically connect to and disconnect from a respective first contact.

2. The device of claim 1, wherein said input means comprises a movable rocker member.

3. The device of claim 1, wherein said toggle arm has a spring notch to retain said toggle spring, said spring notch being situated within a bottom tip of said toggle arm; said toggle spring being a coil spring with a cross portion at said first end, said cross portion extending through said spring notch to retain said toggle spring at said first end.

4. The device of claim 1, wherein said brush assembly further comprises a fixed brush back plate integral with said at least one movable brush arm.

5. The device of claim 1, wherein said at least one terminal assembly further comprises a clamp wall, a contact arm integral thereto, and wherein said first contact is integral to said contact arm.

6. An electrical switch as defined in claim 1, wherein said spring rests are positioned along a longitudinal axis of said housing and said spring stops are arranged on an axis perpendicular to said longitudinal axis of said housing.

7. An electrical switch as defined in claim 1, wherein said pin is located at an intersection of a central longitudinal axis and a transverse axis of said housing and said spring rests are positioned along the longitudinal axis of said housing and said spring stops are positioned along said transverse axis of said housing.

8. An electrical switch as defined in claim 7, wherein each of said spring stops has a leading edge adjacent said pin and a trailing edge remote from said pin and an oblique sloping surface extending from said leading edge to said trailing edge of said spring stop.

9. An electrical switch as defined in claim 1, wherein each of said spring stops has a leading edge adjacent said pin and a trailing edge remote from said pin and an oblique sloping surface extending from said leading edge to said trailing edge of said spring stop.

10. An electrical switch comprising:

a housing having a base member, said base member having an interior surface with a pin therein projecting away from said interior surface of said base member;

input means connected to said housing and suitable for direct contact by a user;

an actuating arm movable in response to movement of said input means, wherein said actuating arm is integral with said input means;

said actuating arm effectuating on/off control of said electrical switch in response to said user contact;

toggle means responsive to movement of said input means for retaining said switch in a position caused by said contact by said user;

a toggle spring having a first end and a second end connected to said toggle means at said first end and to said pin at said second end said toggle spring being compressed during the first half of travel of said input means and expanding during the second half of travel of said input means;

two spring stops extending upwardly from said interior surface in the same direction as said pin to support a side portion of said toggle spring at either end of said input means travel;

two spring rests extending upwardly from said interior surface in the same direction as said pin to support said toggle spring and space said second end of said toggle spring above said interior surface of said base member; and contact means responsive to movement of said actuating arm for gating the flow of electrical current through the switch.

11. The device of claim 10, wherein said input means comprises a movable rocker member.

12. The device of claim 10, wherein said toggle means has a spring notch to retain said toggle spring, said spring notch being situated within a bottom tip of said toggle means; said toggle spring being a coil spring with a cross portion at said first end, said cross portion extending through said spring notch to retain said toggle spring at said first end.

13. An electrical switch as defined in claim 10, wherein said spring rests are positioned along a longitudinal axis of said housing and said spring stops are arranged on an axis perpendicular to said longitudinal axis of said housing.

14. An electrical switch as defined in claim 10, wherein said pin is located at an intersection of a central longitudinal axis and a transverse axis of said housing and said spring rests are positioned along the longitudinal axis of said housing and said spring stops are positioned along said transverse axis of said housing.

15. An electrical switch as defined in claim 14, wherein each of said spring stops has a leading edge adjacent said pin and a trailing edge remote from said pin and an oblique sloping surface extending from said leading edge to said trailing edge of said spring stop.

16. An electrical switch as defined in claim 10, wherein each of said spring stops has a leading edge adjacent said pin and a trailing edge remote from said pin and an oblique sloping surface extending from said leading edge to said trailing edge of said spring stop.

* * * * *